US005743193A

United States Patent [19]

Kakuta et al.

[11] Patent Number: 5,743,193

[45] Date of Patent: Apr. 28, 1998

[54] TABLE WITH AN ELEVATING PANEL, AN ELEVATING TABLE AND A COMBINATION THEREOF

[75] Inventors: Tomokazu Kakuta, Yokohama; Tetsuya Narita, Funabashi; Makoto Takahashi, Ayase; Nobuyuki Kojima, Yokohama, all of Japan

[73] Assignee: Okamura Corporation, Japan

[21] Appl. No.: 775,203

[22] Filed: Dec. 30, 1996

[30] Foreign Application Priority Data

| | | | |
|---|---|---|---|
| Jan. 18, 1996 | [JP] | Japan | 8-006327 |
| Jan. 18, 1996 | [JP] | Japan | 8-006887 |
| Jan. 18, 1996 | [JP] | Japan | 8-006888 |

[51] Int. Cl.[6] ..... A47B 9/00

[52] U.S. Cl. ..... 108/147; 108/50.11; 108/106; 312/196

[58] Field of Search ..... 108/50, 60, 64, 108/147, 106, 50.11; 312/195, 196

[56] References Cited

U.S. PATENT DOCUMENTS

| | | | |
|---|---|---|---|
| 2,944,861 | 7/1960 | Lessin | 312/196 |
| 3,083,417 | 4/1963 | Cook | 312/196 X |
| 3,770,334 | 11/1973 | Weber | 312/196 X |
| 3,820,176 | 6/1974 | Feiertag | 108/147 X |
| 4,852,500 | 8/1989 | Ryburg et al. | 108/50 X |
| 4,879,955 | 11/1989 | Moll et al. | 108/50 |
| 4,936,228 | 6/1990 | Capo-Bianco | 312/196 X |
| 5,103,741 | 4/1992 | Grund et al. | 108/50 |
| 5,403,082 | 4/1995 | Kramer | 108/50 X |
| 5,540,160 | 7/1996 | Rea | 108/147 X |

FOREIGN PATENT DOCUMENTS

| | | | |
|---|---|---|---|
| 0006707 | 1/1980 | European Pat. Off. | 108/50 |

*Primary Examiner*—Jose V. Chen
*Attorney, Agent, or Firm*—Hoffman, Wasson & Gitler

[57] ABSTRACT

In an office, a main table with an elevating panel is combined with an auxiliary elevating table with various arrangements. The elevating panel is elevated and lowered with respect to the main table. In the auxiliary table, the height of a top is variable. The auxiliary table is stored or concealed from view under the top of the main table at the lowest position, and is arranged at the same height at the intermediate position. At the highest position, the auxiliary table is higher than the main table. Depending on use, the whole surface area of the tops of the tables is variable.

6 Claims, 10 Drawing Sheets

TABLE WITH AN ELEVATING PANEL, AN ELEVATING TABLE AND A COMBINATION THEREOF

BACKGROUND OF THE INVENTION

The present invention relates to a table with an elevating panel, an elevating table and a combination thereof.

In an office, a plurality of desks which have rectangular tops and comprise rectangular parallelepiped are contacted and faced, or are arranged at a certain space to form a working area for a team.

To enlarge working area on a desk, a side or auxiliary table may be disposed on the front edge of the desk to form an L-shape. In an office, with requirement of increase in intellectual productivity, a plurality of teams are organized for each project. As soon as one project finishes, the team is broken up. When another project begins, a new team which comprises different members are organized for the project.

In such a case, to manage team working most efficiently, it would be necessary to arrange members in charge side by side for closer business. Even in the same team, depending on working order or sudden change in combination, adjacent members are variable. Depending on circumstances, it would be necessary to make a round table conference for the whole members of the team. Futhermore, one business may avoid the whole area of the desk, but only auxiliary table is needed to make closer relationship with an adjacent desk.

On the contrary, the area of the main desk is insufficient, and it may be desirable to use larger area with an auxiliary table. In this case, the auxiliary table is made to be lower than the main desk so that the auxiliary table may be stored under the main desk. When the tables are arranged, there is difference in height.

However, it would be impossible for an ordinary desk to change the area of a top or to arrange them in a circle. It is impossible to fold or overlap the tables since the desk has no caster, large weight and rectangular parallelepiped which has four legs. So, in the conference, additional conference room or tables would be required. It requires high cost to maintain the room or to store furniture. Screens or partitions around the desk are provided separately from the desk, so that it would be impossible to adjust height freely.

As disclosed in Japanese Utility Model Laid-Open Pub. No. 63-85131, there is a height adjusting device for a rear panel which can be elevated vertically on the rear surface of a panel, the device being provided on the lower surface of a top of a desk, the rear panel being movable up and down with rotation of a drive shaft driven by a handle, a locking member for locking rotation of the drive shaft being engaged and disengaged by pushing the handle. The table contains not only the panel but also the drive shaft and locking member, the panel being elevated by operating the handle at the front portion. Therefore, it would be necessary to make a special structure for containing the elements above, which makes the device itself complicate and expensive. The panel cannot be mounted or removed with respect to the table. To elevate and lower the panel by screw movement with rotation of the drive shaft, it would take a lot of time.

In a conventional elevating table, a vertical leg is fixed in the middle of a base for support legs, and the upper end of an elevating device in the leg is fixed to the lower surface of a rectangular top. An operating lever for the elevating device is provided on the front portion of the lower surface of the top. The device has a good balance in weight and is stable, but the leg which stands in the middle of the lower surface of the top is likely to get in touch with a leg of an user. Therefore, it becomes more difficult to use it, and to move the table without casters. When the top has small area, a knee is likely to get in touch with the legs of the table, so that it will be difficult to make it smaller.

SUMMARY OF THE INVENTION

It is an object of the present invention to provide an inexpensive table with an elevating panel which is readily elevated.

It is another object of the present invention to provide a table with an elevating panel which stably supports a screen adjacent the table even if the height of the panel is changed.

It is still another object of the present invention to provide a table with an elevating panel, the table being easily movable.

It is a further object of the present invention to provide a table with an elevating panel in which the height of the top is freely variable.

It is a still further object of the present invention to provide an elevating table to improve foot allowable space owing to vertical leg in the middle of the lower surface of a rectangular top, thereby facilitating use and making it smaller.

It is another object of the present invention to provide a combination of tables which are freely movable and flexibly convertible in arrangement, area and figure depending on types and scale of operation in an office without a rectangular desk.

It is still another object of the present invention to provide a combination of tables in which a main table has the same height as an auxiliary table which can be stored under the main table.

It is a further object of the present invention to provide a combination of tables which have a partition which has the most suitable height for each choice and cooperation in working.

According to one aspect of the present invention, there is provided a table with an elevating panel, comprising:

a top of the table;

a plurality of brackets at a side of the top of the table; and a plurality of vertical slide rails on the elevating panel which projects on the top, said plurality of brackets being slidably engaged in said plurality of slide rails so that the slide rails may be held at a desired height with respect to the brackets.

The inexpensive table in which the panel can be easily elevated and lowered is provided.

According to another aspect of the present invention, there is provided an elevating table which comprises:

a top;

a base;

support legs which are opened like V-shape forwards from the base;

a leg which is fixed to the base at a lower end, the leg being slightly inclined forwards;

elevating means in the leg, an upper end of the elevating means being fixed to a rear end of a lower surface of the top; and operating means for the elevating means at a front end of the base of said support leg.

Compared with a conventional table in which the leg is mounted in the middle of the lower surface of a rectangular top to prevent a leg of a user from free movement, the leg of the user can be freely moved by mounting the leg of the table to the base for the V-shape-opened support legs with inclination.

According to a further aspect of the present invention, there is provided a combination of tables which comprise:

a main table which has a roughly triangular top in which a longest side is concave, and a leg in which an upper end is fixed to a vertex of the triangular top on a lower surface; and a movable auxiliary table which has a triangular top in which a longest side is concave, and a support leg fixed to a lower surface of the top, casters being mounted to a lower surface of the support leg.

The main and auxiliary tables both provide the longest side which is concave, so that a user can comfortably work in view of human engineering. The main and auxiliary tables both have legs which have casters at the lower ends, thereby facilitating movement of the tables.

The top of the auxiliary table is elevatably supported by elevating means of the support legs. Thus, the auxiliary table can be stored or concealed from view under the main table, or the auxiliary table is as high as the main table, thereby providing advantage that the surface area of the table is variable.

The panel is elevatably supported by the main table. Therefore, even during operation, privacy can be protected and important memorandums can be attached on the panel.

BRIEF DESCRIPTION OF THE DRAWINGS

The features and advantages of the present invention will become more apparent from the following description with respect to embodiments based on the appended drawers wherein.

DETAILED DESCRIPTION OF PREFERRED EMBODIMENTS

Figure 1:
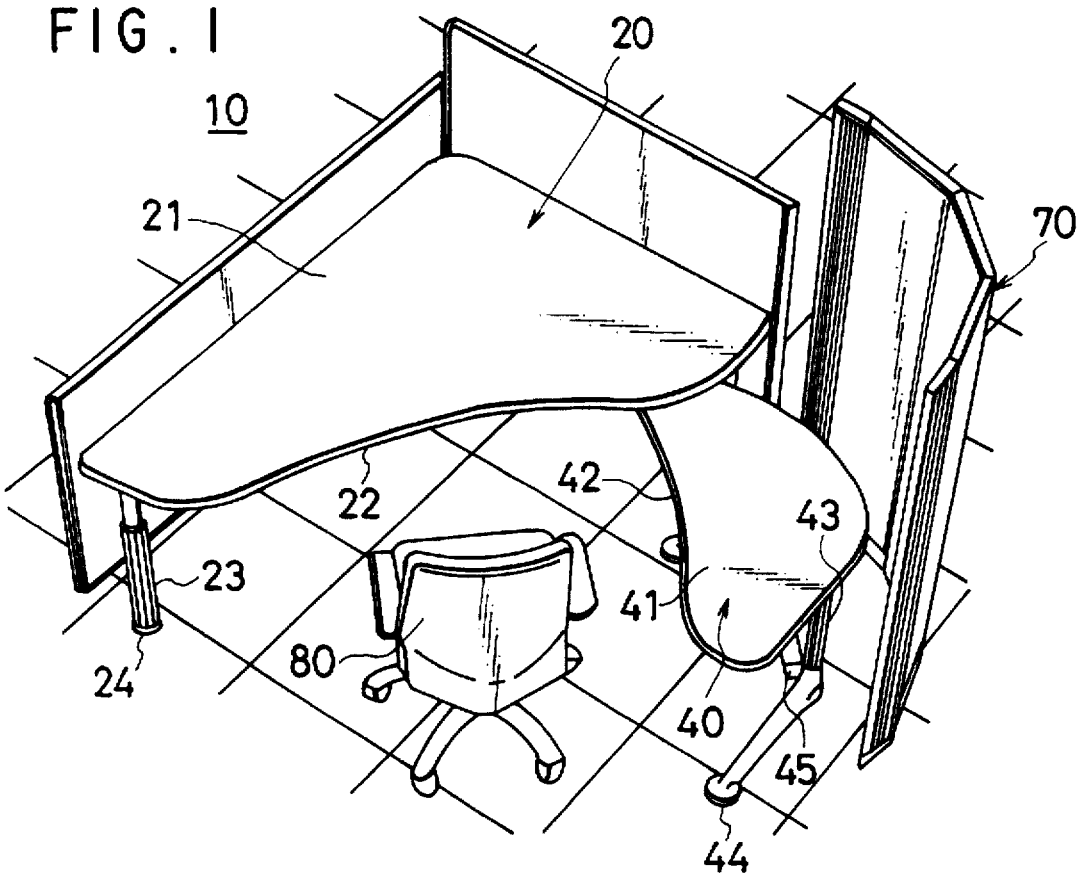
FIG. 1 is a perspective view of a combination of tables according to the present invention in an office.

FIG. 1 is a perspective view of a combination of tables according to the present invention located in an office.

The numeral 20 denotes a movable main table which has a roughly right triangular top 21, the longest side of which is concave. At the vertex on the lower surface of the triangular top 21, the upper end of a leg 23 which has a caster 24 at the lower end is mounted. If necessary, the caster 24 of the main table 20 may be omitted.

An auxiliary table 40 has a triangular top 41 which is similar in figure to the top of the main table 20. The longest side 42 of the auxiliary table 40 is concave, and a caster (not shown in FIG. 1) is mounted on the lower surface of a leg 43 which is fixed to the lower surface of the top 40.

The top 41 of the auxiliary table 40 is kept to a desired height within a movable range by a gas spring in the leg 43, and is operated by a pedal 45 at the lower end of the leg 43.

At the lowest position of the top 41, the whole auxiliary table 40 can be stored or concealed from view under the top 21 of the main table 20. At the intermediate position, the top 41 is kept at the same height as the top 21. At the highest position, the top 41 of the auxiliary table 40 is higher than the top 21 of the main table 20.

Figure 2:
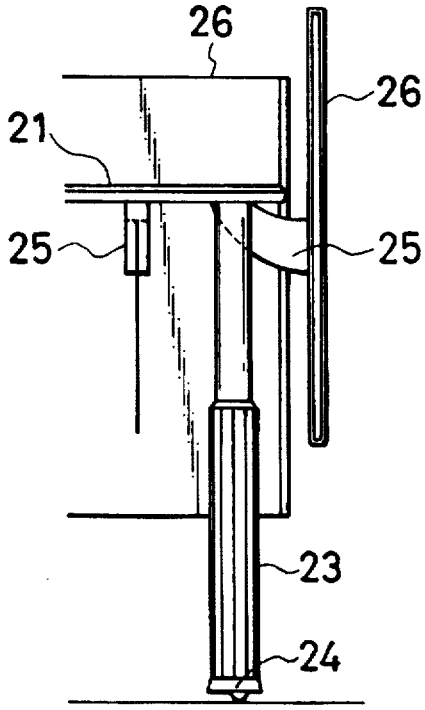
FIG. 2 is a partially front view of one embodiment of a main table according to the present invention.

As shown in FIG. 2, at the lower surface of the top 21 of the main table 20, an upright screen and pinup panel 26 is fixed via a bracket 25, thereby keeping a use isolated during operation.

Figure 3:
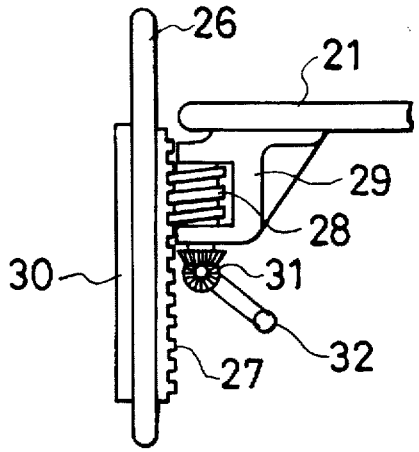
FIG. 3 is a front view of elevating means for a panel in another embodiment of the present invention.

The panel 26 can move up and down vertically. For example, as shown in FIG. 3, on the inner surface of the panel 26, at least two parallel racks 27 are fixed vertically, and a bracket 29 for supporting two worms 28 engaged with the racks 27 is fixed on the lower surface of the top 21. The panel 26 is supported by a guide 30, and a bevel gear 31 and a handle 32 for rotating the worms 28 are provided. Rotating the handle 32, the worm 28 is rotated to elevate and lower the rack 27. When the handle 32 is stopped, the panel 26 is held at the height by engagement of the rack 27 with the worm 27.

Figure 4:
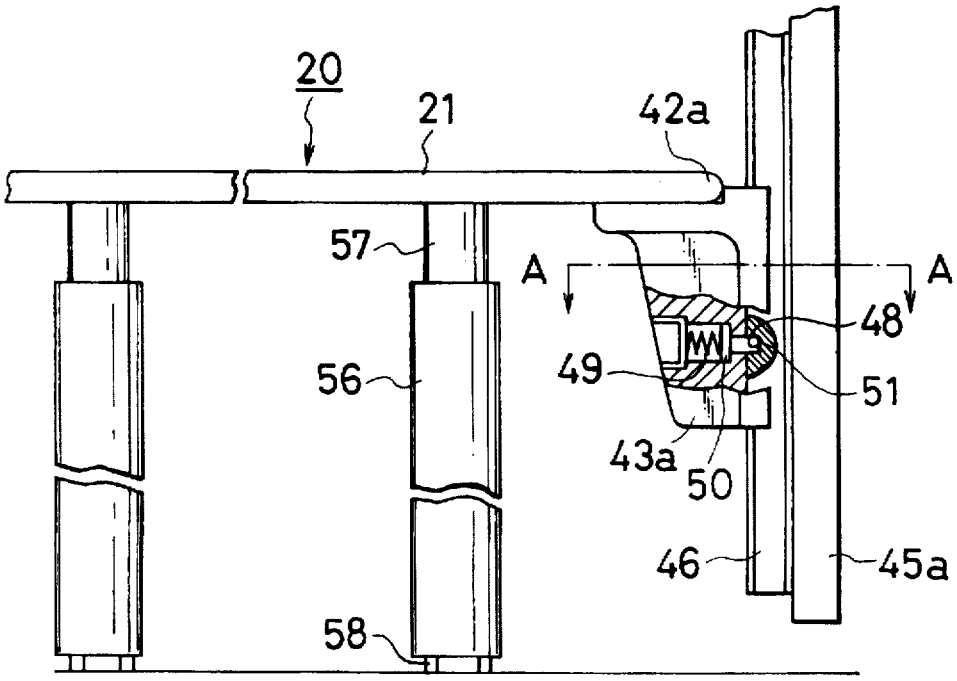
FIG. 4 is a partially front view of a further embodiment of a table with an elevating panel according to the present invention.
Figure 5:
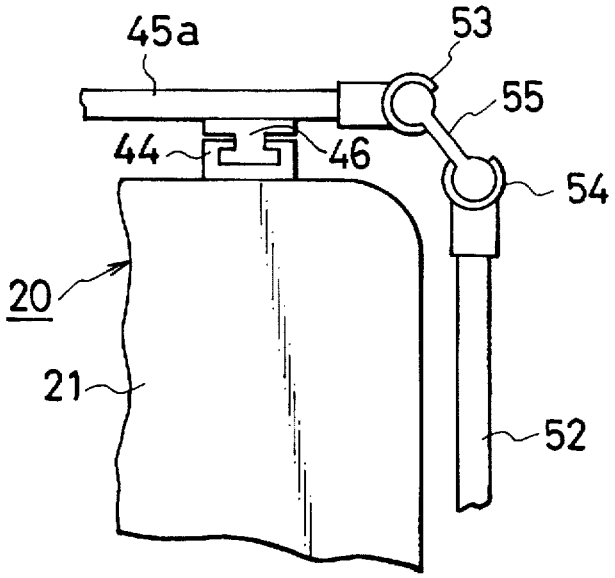
FIG. 5 is a partially plan view of yet another embodiment of a table with an elevating panel according to the present invention.
Figure 6:
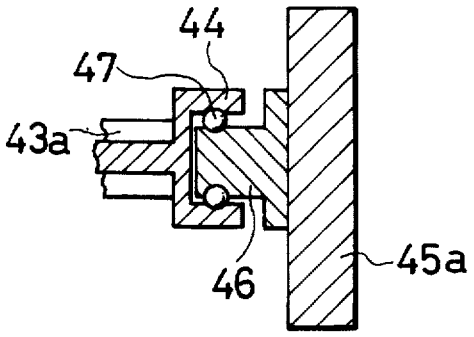
FIG. 6 is a horizontal sectional view taken along the line A—A in FIG. 4.

FIG. 4 is a partially omitted front elevational view of another embodiment of an elevating-panel-having-table, and FIG. 5 is a partially top plan view thereof. As shown in FIG. 4, two brackets **43*a* are fixed on the lower surface of the side end 42*a* of the top 21. The bracket 43*a* projects from the top 21, and has a U-sectioned engagement groove 44 as shown in FIG. 6**.

To hold the panel **45*a* at a desired height, a suitable number of bores 48 are formed in a slide rail 46. In the engagement groove 44 of the bracket 43*a*, a spherical end portion of a stopper pin 50 usually pressed by a compression spring 49 or a ball 51 is slightly projected. The spherical end portion of the stopper pin 50 or of the ball 51 is engaged in the bore 48, so that the panel 45*a* is held at the height. When the panel is strongly moved, the engagement is easily untied, thereby changing the height of the panel 45*a* easily. The panel 45*a* is provided as a screen during operation, and has a slide rail 46 which is slidably engaged in the engagement groove 44 of the bracket 43***a*. As shown in FIG. 6, the slide rail 46 of the panel 45*a* is engaged in the engagement groove 44 of the bracket 43*a*. A plurality of balls 47 held by a retainer is provided between them, thereby making sliding movement smooth.

To provide an equal height screen 52 between an adjacent table, the panel 45a is used. As shown in FIG. 5, at the side end of the panel 45*a*, a semi-circular sectioned catcher 53 is provided as shown in FIG. 5, and a catcher 54 at the side end of the screen 52. A joint 55 is provided between the catchers 53 and 54. Thus, the panel 45 is only elevated, while the screen 52 is kept at a predetermined height.

To hold the top 21 of the table 20 at a predetermined height, only the panel 45*a* can be elevated. To move the top 21 of the table 20 up and down, gas springs, hydraulic jacks or screw-type jacks are provided in all the legs 58 so that they may be synchronized or cooperated. The upper ends 57 of the elevating means are fixed to the lower surface of the top 21.

To facilitate transportation, to change the direction of the tables easily, or to prevent momentary undesirable movement, a caster 58 with a stopper may be mounted on the lower surface of the leg 56.

Figure 7:
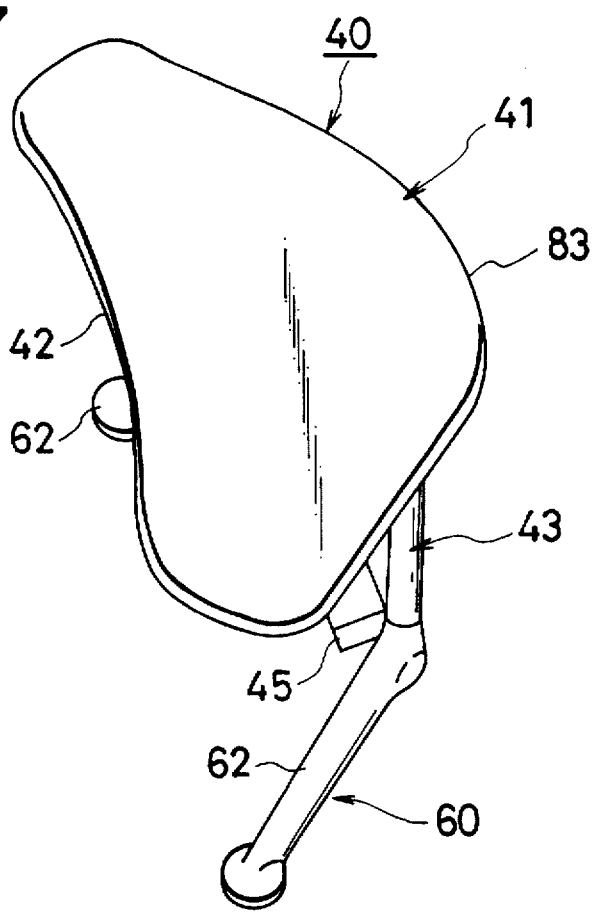
FIG. 7 is a perspective view of one embodiment of an elevating table according to the present invention.
Figure 8:
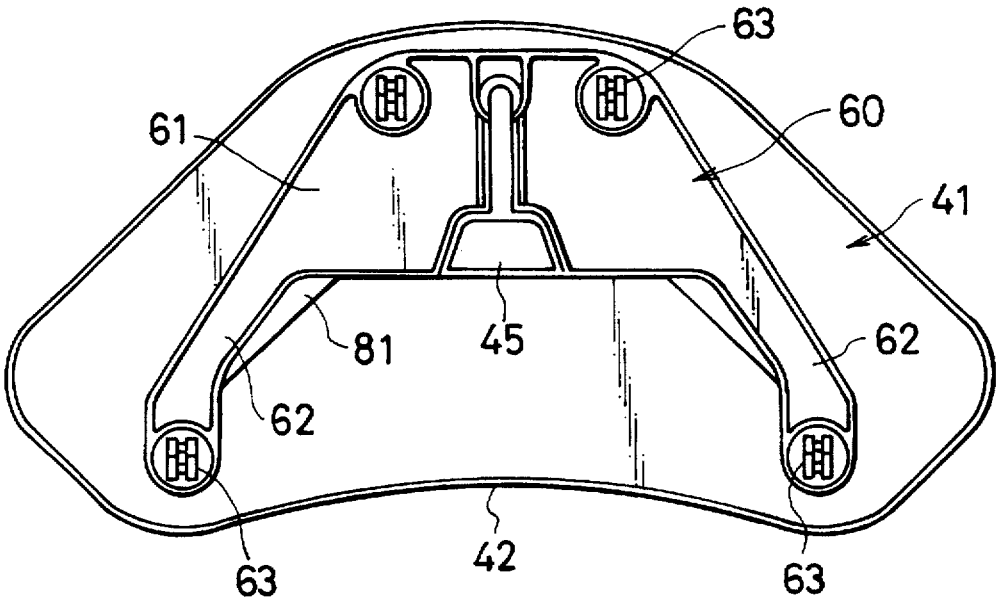
FIG. 8 is a bottom plan view thereof.

FIGS. 7 and 8 show an elevating table 40. The numeral 60 denotes a support leg; 61 denotes a base; 62 denotes a foot; and 63 denotes casters mounted on the lower surface of the base 61 and on the lower surface of the front end of the foot 61.

Figure 9:
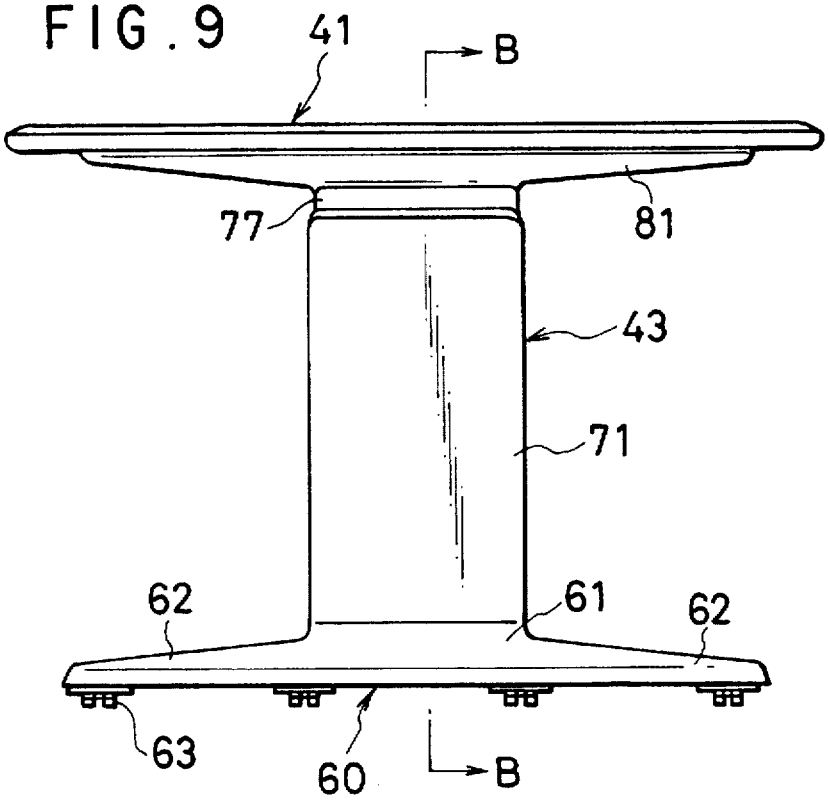
FIG. 9 is a rear elevational view thereof.
Figure 10:
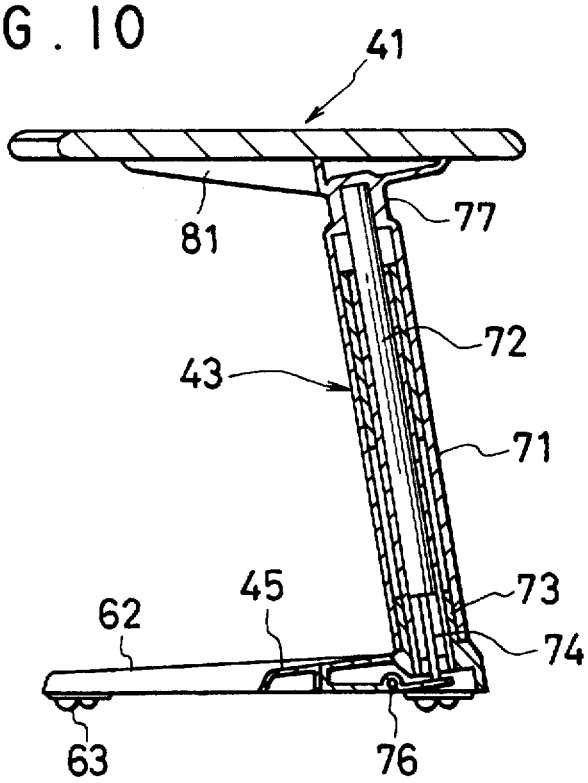
FIG. 10 is a vertical sectional view taken along the line B—B in FIG. 9.
Figure 11:
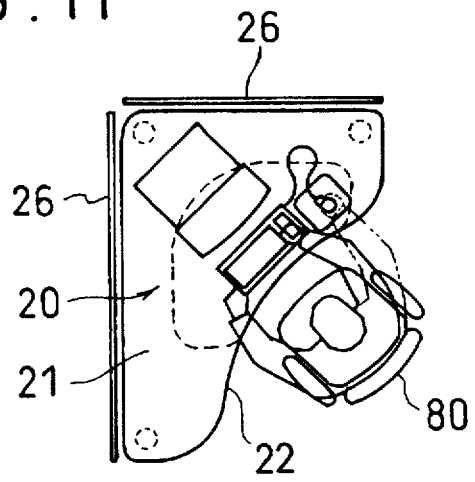
FIG. 11 is a top plan view of the first arrangement of a combination of tables according to the present invention.
Figure 12:
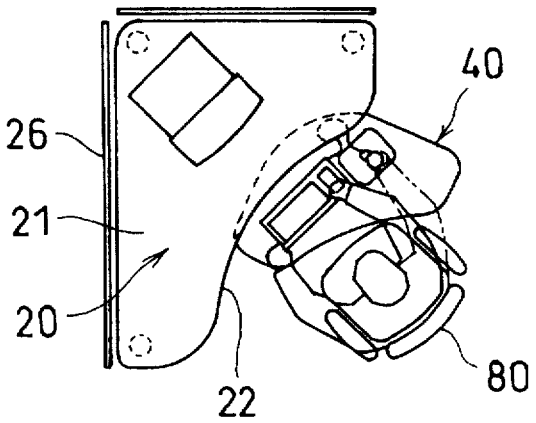
FIG. 12 is a top plan view of the second arrangement thereof.
Figure 13:
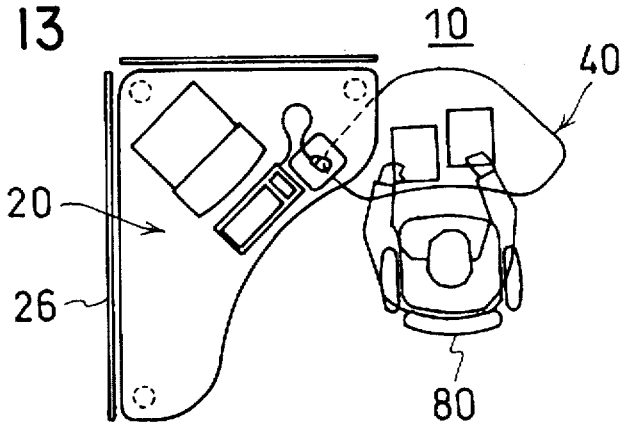
FIG. 13 is a top plan view of the third arrangement thereof.
Figure 14:
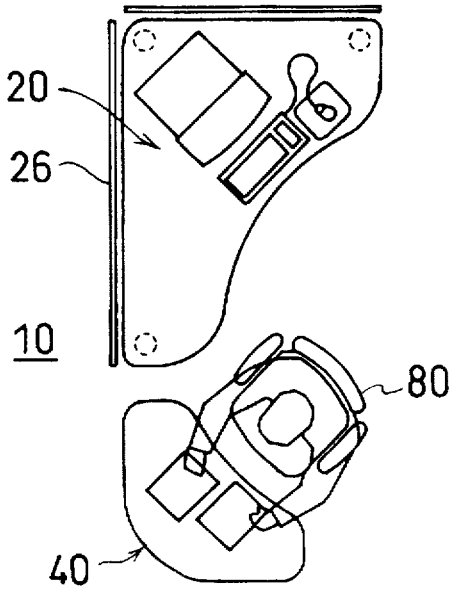
FIG. 14 is a top plan view of the fourth arrangement thereof.
Figure 15:
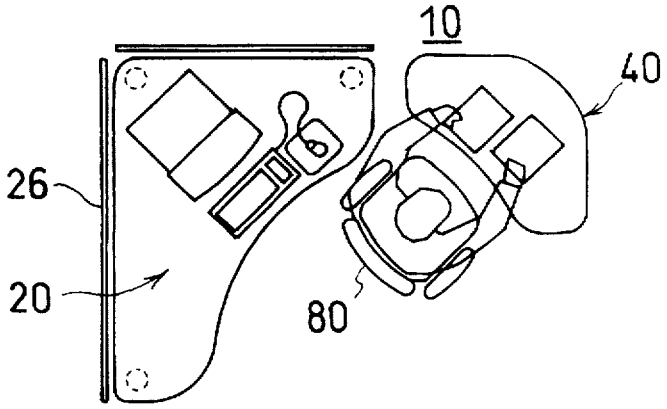
FIG. 15 is a top plan view of the fifth arrangement thereof.
Figure 16:
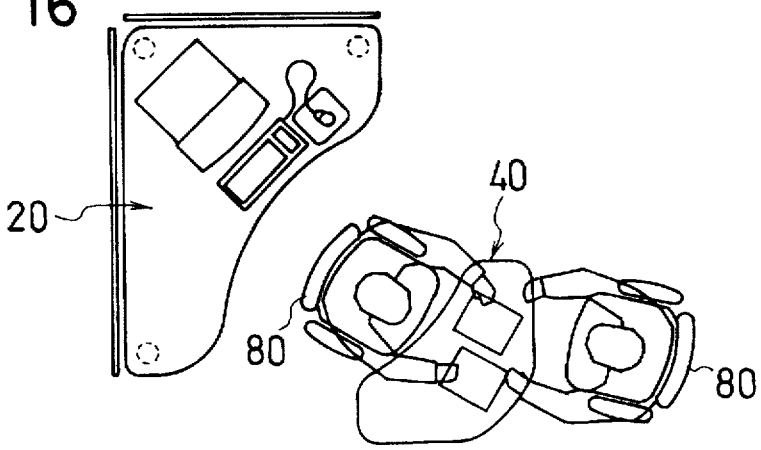
FIG. 16 is a top plan view of the sixth arrangement thereof.
Figure 17:
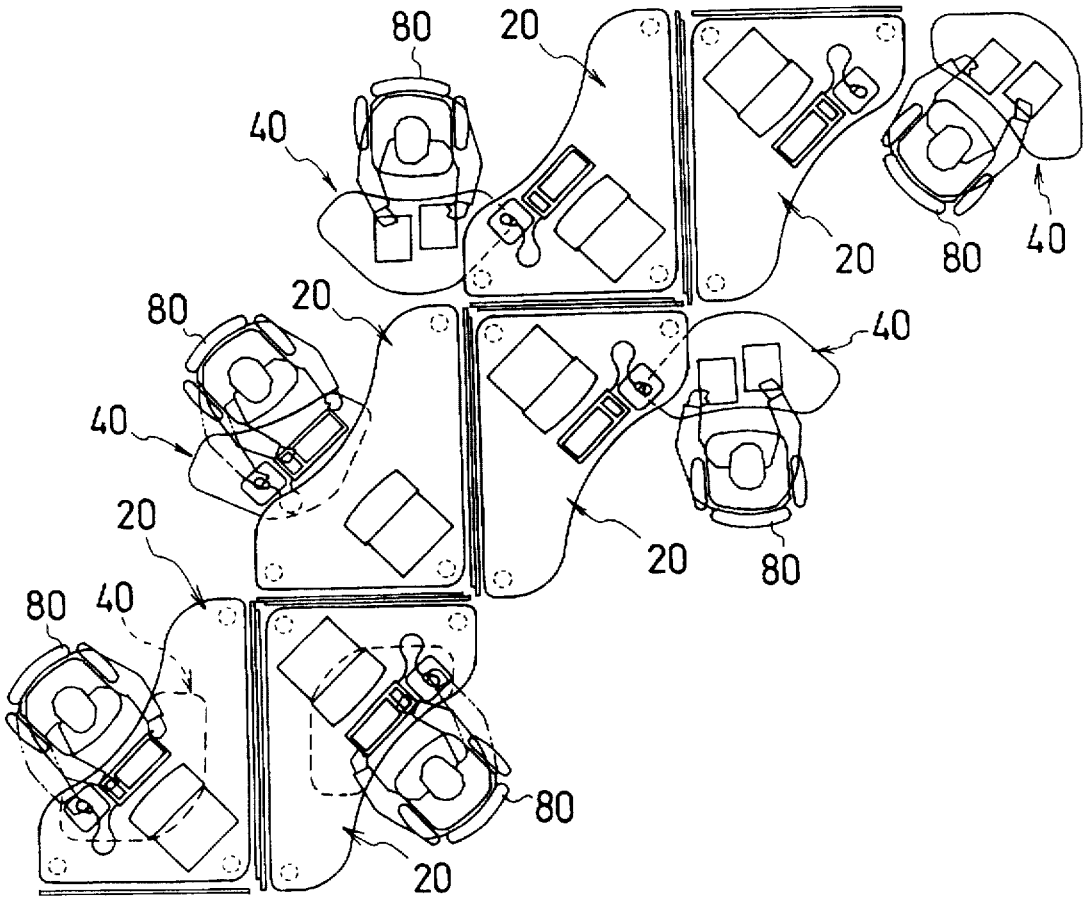
FIG. 17 is a top plan view of the first arrangment of a plurality sets of a combination of tables according to the present invention.
Figure 18:
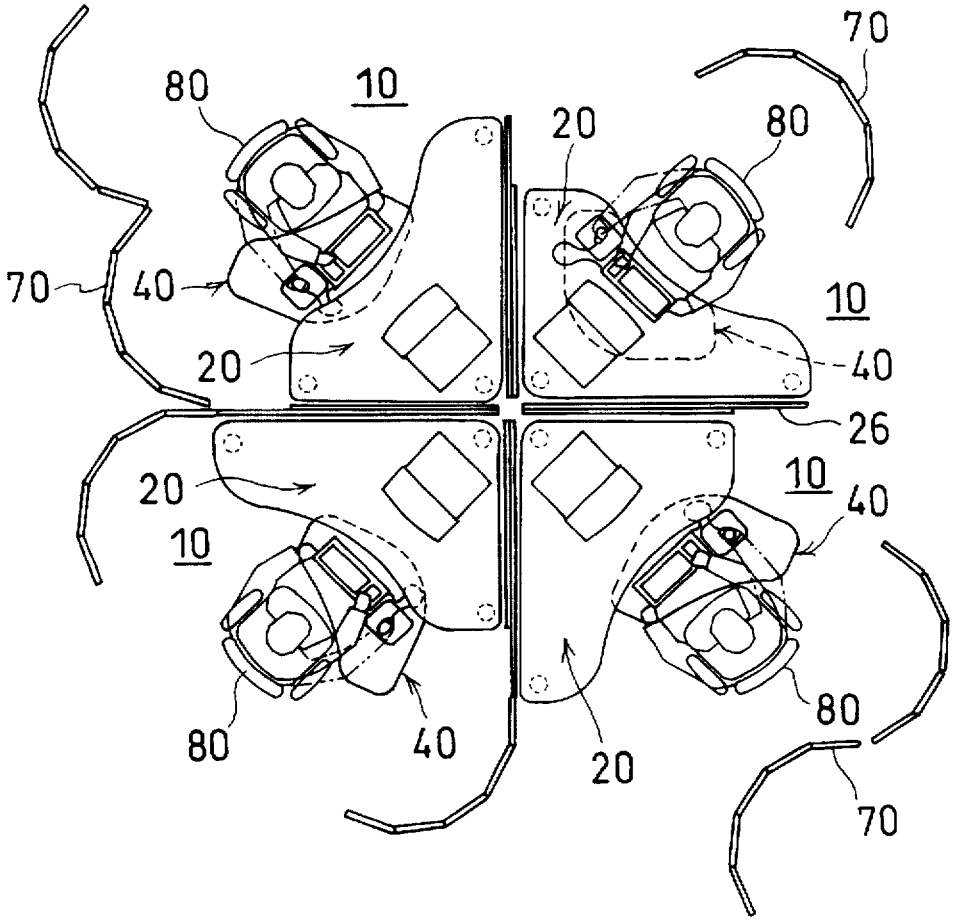
FIG. 18 is a top plan view of the second embodiment thereof.
Figure 19:
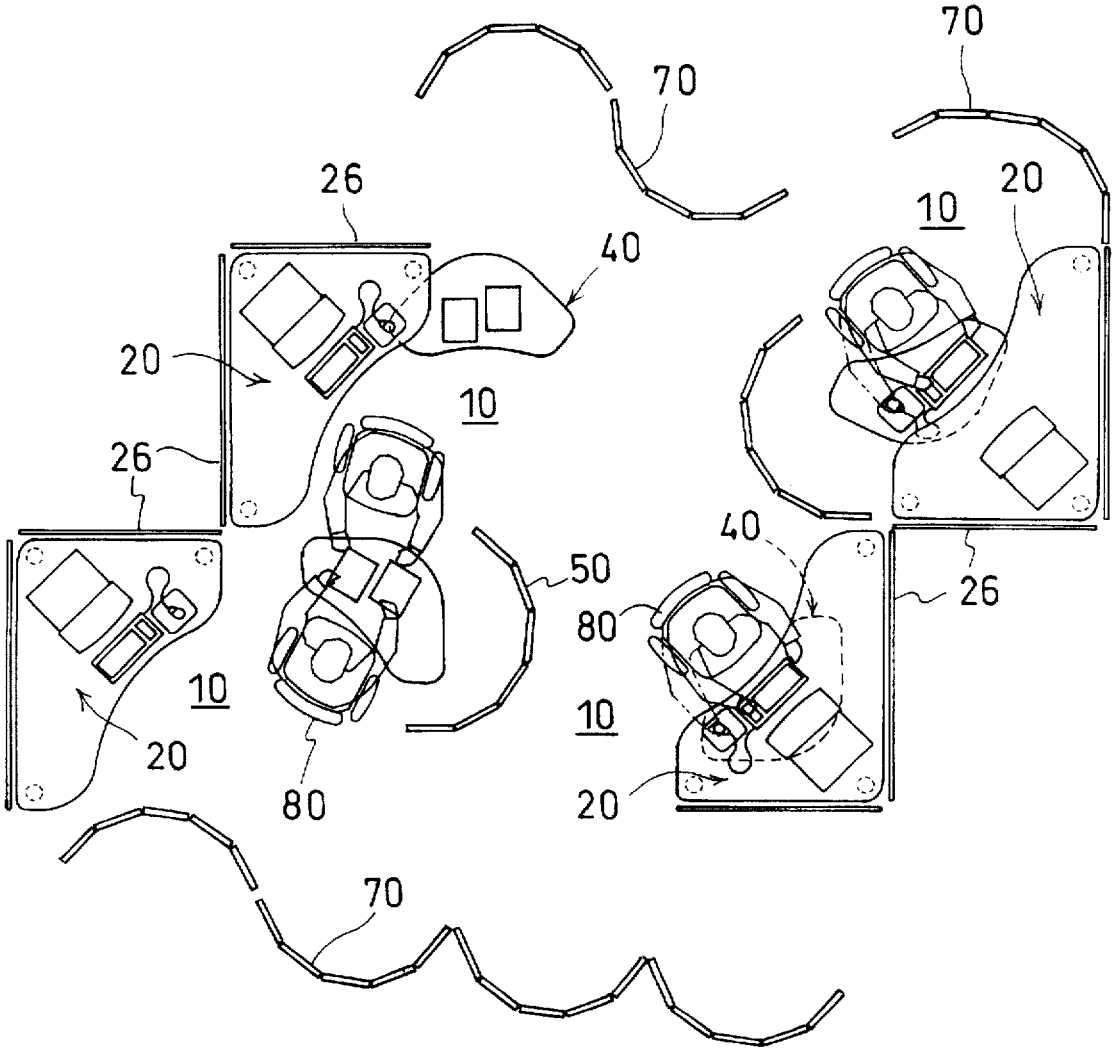
FIG. 19 is a top plan view of the third embodiment thereof.

The numeral 43 in FIGS. 7, 8 and 9 denotes a leg connected to the top 41 and the support leg 60 so that the top 41 may be elevated. 71 denotes a leg cover; 72 denotes elevating means such as a gas spring; and 73 denotes a lower end of the leg 43 fixed to the base of the leg 60.

The numeral 74 denotes an operating rod for the elevating means. The operating rod 74 is operated by a pedal 45 projected from the middle of the base 61 of the support, leg 60. 76 denotes a fulcrum of the pedal. 77 denotes the upper end of the elevating means 72, the upper end being fixed to the top 41 via a top support plate 81 near the rear edge. The longest side of the triangular top 41 is concave, which lets the user easier to use in view of human engineering. The top 41 has no corners, and each edge has a semi-circular vertical section.

The top 41 is elevated as follows. To elevate the top 41 slowly, the pedal 45 is stepped slowly, while holding the top 41 by two hands or arms, and the elevating means 72 is extended, so that the top 41 goes up. When the top 41 is elevated to a desired height, your foot is detached from the pedal. The top 41 is lowered while holding it by two hands or arms. When the top 41 moves down to a desired height, a foot of the user is detached from the pedal 45, and the top 41 is stopped.

Various arrangements of combinations of the main and auxiliary tables in an office are shown in FIGS. 11 to 19. The numeral 70 denotes a flexible screen, and 80 denotes a chair with casters.

The foregoings merely relate to embodiments of the present invention. Various changes and modifications may be made by person skilled in the art without departing from the scope of claims wherein:

What is claimed is:

1. A table with an elevating panel, comprising:

a top of the table;

a plurality of brackets at a side of the top of the table, each of the brackets having a plurality of grooves; and a plurality of vertical slide rails on the elevating panel which projects on the top, each of the slide rails having a hemisphere-ended member, said hemisphere-ended member being pushed by elastic means to engage in any of said plurality of grooves so that the slide rails may be held at a desired height with respect to the brackets.

2. The table as defined in claim 1 wherein a joint is slidably engaged in a catcher at a side end of the elevating panel, said joint also being slidably engaged in a side end of a screen so that the elevating panel may vertically slide with respect to the screen.

3. The table as defined in claim 1 wherein casters are mounted at lower ends of legs of the table so that the the table may be movable.

4. The table as defined in claim 3 wherein the top is elevatably supported by legs.

5. The table as defined in claim 1, wherein the hemisphere-ended member comprises a ball.

6. The table as defined in claim 1, wherein the elastic means comprises a compression spring.

* * * * *